US005252184A

United States Patent [19]

Tanaka et al.

[11] Patent Number: 5,252,184

[45] Date of Patent: Oct. 12, 1993

[54] ADDITIVE FOR PRODUCTION OF PAPER

[75] Inventors: Yasumasa Tanaka, Suita; Koichi Yamamoto, Tokyo; Kazutomo Takahashi, Yokohama, all of Japan

[73] Assignee: Nippon Shokubai Kagaku Kogyo Co., Ltd., Osaka, Japan

[21] Appl. No.: 779,852

[22] Filed: Oct. 21, 1991

Related U.S. Application Data

[62] Division of Ser. No. 561,931, Aug. 2, 1990, abandoned.

[30] Foreign Application Priority Data

Aug. 3, 1989 [JP] Japan ..... 1-200342
Nov. 16, 1989 [JP] Japan ..... 1-296239

[51] Int. Cl.[5] ..... D21H 17/41
[52] U.S. Cl. ..... 162/168.2; 162/168.3
[58] Field of Search .....162/168.2, 168.3, 164.6; 210/734

[56] References Cited

U.S. PATENT DOCUMENTS

| | | | |
|---|---|---|---|
| 2,838,397 | 6/1958 | Gruntfest et al. | 162/168.2 |
| 3,280,218 | 10/1966 | Endsley et al. | 528/234 |
| 3,372,149 | 3/1968 | Fertig et al. | 210/734 |
| 3,658,474 | 4/1972 | Rothwell | 210/734 |
| 4,392,917 | 7/1983 | Lipowski | 162/168.2 |

FOREIGN PATENT DOCUMENTS

| | | | |
|---|---|---|---|
| 387567 | 9/1990 | European Pat. Off. . | |
| 2503169 | 6/1976 | Fed. Rep. of Germany | 210/734 |
| 62-205112 | 9/1987 | Japan | 210/734 |

*Primary Examiner*—Peter Chin
*Attorney, Agent, or Firm*—Burns, Doane, Swecker & Mathis

[57] ABSTRACT

An additive for paper production, comprising an amphoteric polymeric electrolyte having as an essential component thereof a structural unit represented by the following general formula I:

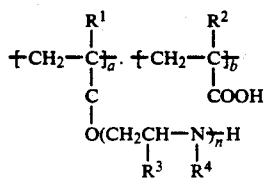

(I)

wherein n is an integer in the range of 1 to 5, $R^1$, $R^2$, and $R^3$ are independently hydrogen atom or an alkyl group, $R^4$ is hydrogen atom, an alkyl group, or a hydroxyalkyl group, and a and b are jointly relative numerals such that the a/b ratio is in the range of 0.2 to 45.0), having at least part of the amino group of said amphoteric polymeric electrolyte neutralized, and possessing a cation equivalent amount (Cv) in the range of 1.0 to 15.0 meq/g, an anion equivalent amount (Av) in the range of 0.1 to 7.0 meq/g, and a Cv/Av ratio in the range of 0.2 to 45.0.

10 Claims, No Drawings

ADDITIVE FOR PRODUCTION OF PAPER

This application is a division of application Ser. No. 07/561,931 filed Aug. 2, 1990, now abandoned.

BACKGROUND OF THE INVENTION

1. Field of the Invention

This invention relates to an additive for the production of paper. More particularly, it relates to an amphoteric polymeric additive for the production of paper, which is capable of retaining in the paper a water drainage-improving action and such additives as filler and sizing agent in high yields under neutral conditions.

2. Description of the Prior Art

In recent years, the neutral paper production has come to prevail in the place of the conventional acidic paper production. The neutral paper production is advantageous in (1) improving the durability of paper, (2) decreasing the possibility of corroding machines, (3) allowing safe use of inexpensive calcium carbonate as a filler, and (4) permitting a paper producing machine to be operated in a closed system, for example.

The adoption of the neutral paper production has given rise to the problem that the drainage aid heretofore used in the acidic paper production is either effectless or effective insufficiently.

For the solution of this problem, the practice of using cationized polyacrylamides obtained by the Mannich reaction of polyacrylamides, cationized starch, homopolymers of tertiary amino group- or quaternary ammonium salt group-containing polymerizable monomers or copolymers of such polymerizable monomers with nonionic monomers, and cationic polymeric compounds such as polyvinyl amines, polyallyl amines, and polyethylene imines, for example, has been in vogue.

More recently, amphoteric polymeric compounds such as Mannich reaction products of acrylic acid-acrylamide copolymers, copolymers of tertiary amino group- or quaternary ammonium salt group-containing polymerizable monomers with acrylic acid, and Hofmann degradation products of polyacrylamides have been finding utility in this practice.

Though these cationic or amphoteric polymeric compounds are used as water permeation-improving agents and as yield-improving agents such as filler and sizing agent under neutral conditions, they have the problem that they are still short of sufficiently fulfiling their roles or they are retained ununiformly in paper.

An object of this invention, therefore, is to provide a novel additive for the production of paper.

Another object of this invention is to provide an amphoteric polymeric additive for the production of paper, which enables the water drainage improving action and such additives as filler and sizing agent to be retained in high yields in paper.

Yet another object of this invention is to provide a novel pulp composition.

SUMMARY OF THE INVENTION

The objects described above are accomplished by an additive for the production of paper, comprising an amphoteric polymeric electrolyte having as an essential component thereof a structural unit represented by the general formula I:

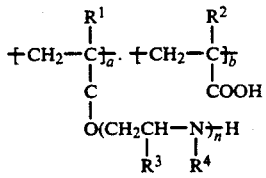

(I)

wherein n is an integer in the range of 1 to 5, $R^1$, $R^2$, and $R^3$ are independently hydrogen atom or an alkyl group, $R^4$ is hydrogen atom, an alkyl group, or a hydroxyalkyl group, and a and b jointly are relative numerals such that a/b is in the range of 0.2 to 45, having at least part of the amino group of the amphoteric polymeric electrolyte neutralized, and possessing a cation equivalent value (Cv) in the range of 1.0 to 15.0 meq/g, an anion equivalent value (Av) in the range of 0.1 to 7.0 meq/g, and a Cv/Av ratio in the range of 0.2 to 45.0.

EXPLANATION OF THE PREFERRED EMBODIMENT

In the general formula I mentioned above, n is an integer in the range of 1 to 5, preferably 1 to 3, $R^1$, $R^2$ and $R^3$ are independently a hydrogen atom or an alkyl group, providing that the number of carbon atoms of the alkyl group is in the range of 1 to 3, preferably 1 to 2, $R^4$ is hydrogen atom, an alkyl group, or a hydroxyalkyl group, providing that the number of carbon atoms of the alkyl group or hydroxyalkyl group is in the range of 1 to 3, preferably 1 to 2, and a and b are jointly relative numerals such that the a/b ratio is in the range of 0.2 to 45, preferably 0.5 to 40. Viscosity of an aqueous 10% solution of amphoteric polymeric electrolyte (Brookfield viscosity at pH 3.5 and 25° C.) is in the range of 50 to 100,000 cps, preferably 100 to 20,000 cps.

Though no particular method is specified for the production of the additive for the production of paper in the present invention, the following methods prove to be preferable.

(1) The method which comprises causing a vinyl type carboxylic acid monomer to react with an alkylene imine thereby forming an aminoalkyl ester monomer and copolymerizing a salt of the aminoalkyl ester monomer with a vinyl group carboxylic acid monomer, (2) the method which comprises polymerizing a vinyl type carboxylic acid monomer thereby forming a vinyl type carboxylic acid polymer, causing an alkylene imine to react with the polymer thereby aminaokylating the polymer, and neutralizing the aminoalkylation product with an acid, (3) the method which comprises preparing an aminoalkyl ester monomer of the reaction product of a vinyl type carboxylic acid monomer with an alkylene imine, subjecting a salt of the aminoalkyl ester monomer and a vinyl type carboxylic acid monomer to water-in-oil emulsification in the presence of water, a surfactant, and a hydrophobic organic solvent, and then copolymerizing the emulsification product, and (4) the method which comprises emulsifying a vinyl type carboxylic acid in the water-in-oil form in the presence of water, a surfactant, and a hydrophobic organic solvent, polymerizing the emulsification product, causing an alkylene imine to react with the resultant vinyl type carboxylic acid polymer emulsion thereby aminoalkylating the polymer emulsion, and neutralizing the aminoalkylation product.

In the production of the additive of this invention for the production of paper, copolymerization of a nonionic monomer may be resorted to for the purpose of adjusting the molecular weight and the ion equivalent.

The vinyl type carboxylic acid monomers which are advantageously usable herein include acrylic acid, methacrylic acid, and ammonium salts of such acids, for example.

Particularly where the additive for the production of paper is synthesized by the method of (4), the vinyl type anionnic monomer is preferable to be an ammonium salt. In this case, the neutralization ratio of the vinyl type anionic monomer is in the ratio of 5 to 100 mol %, preferably 20 to 95 mol %.

The nonionic monomers which are usable herein include (meth)acryl amides, N,N-dimethyl (meth)acryl amides, N,N-diethyl (meth)acryl amides, hydroxyethyl (meth)acrylates, hydroxypropyl (meth)acrylates, hydroxyethyl (meth)acryl amides, hydroxypropyl(meth-)acryl amides, and acrylonitrile, for example.

The alkylene imines which are used preferably herein are 1,2-alkylene imine (aziridines). Among other alkylene imines mentioned above, 1,2-propylene imine and ethylene imine prove to be particularly desirable on account of their ready availability and relative inexpensiveness. Optionally, other substituted 1,2-aziridines may be used.

The polymerization in any of the aforementioned methods of (1), (2), (3), and (4) can be carried out by the conventional method using a peroxide type, an azo type, or a redox type polymerization initiator as popularly practised. The amount of the polymerization initiator to be used in the polymerization is in the range of 0.001 to 10% by weight, preferably 0.01 to 0.5% by weight.

Ammonium persulfate, potassium persulfate, hydrogen peroxide, and cumene hydroperoxide may be cited as examples of the peroxide type initiator. Azobisisobutyronitrile, 2,2'-azobis(2-amidinopropane) dihydrochloridel, 2,2'-azobis(2,4-dimethylvaleronitrile), and 4,4'-azobis (4cyanopentanoic acid) may be cited as examples of the azo type initiator. Formaldehyde sodium sulfoxylate, thioglyconic acid, L-ascorbic acid, dimethyl aminopropionitrile, sodium hydrogen sulfite, B-mercaptoethanol, and combinations of divalent iron salts with reducing agents may be cited as examples of the redox type initiator. It is permissible to use a peroxide type initiator or a redox type initiator in combination with an azo type initiator.

The polymerization system may incorporate therein any of the well-known chain transfer agents such as isopropyl alcohol, erythruvic acid, and 2-mercaptoethanol.

The conventional nonionic surfactants may be cited as examples of the surfactant to be used for the water-in-oil emulsification involved in the aforementioned methods of (3) and (4). These nonionic surfactants include sorbitan monooleate, sorbitan monostearate, sorbitan monolaurate, polyoxyethylene sorbitan monooleate, polyoxyethylene nonylphenyl ether, polyoxyethylene lauryl ether, and glycerol monooleate, for example. These nonionic surfactants may be used either singly or in the form of a combination of two or more members.

Such a nonionic surfactant may be used in combination with ordinary anionic and cationic surfactants.

Hydrophobic aliphatic and aromatic hydrocarbons and plant and animal oils and modified oils thereof may be cited as examples of the hydrophobic organic solvent. These hydrophobic organic solvents are represented by normal paraffin, isoparaffin, cyclohexane, naphthene, toluene, xylene, mineral oils, and kerosene.

The total concentration of the salt of an aminoalkyl ester monomer, the vinyl type anionic monomer, and the nonionic monomer in the method of (3) and the total concentration of the vinyl type anionic monomer and the nonionic monomer in the method of (4) are each desired to be in the range of 20 to 80% by weight, based on the amount of water. The concentration of the surfactant to be used therein is preferable to be in the range of 5 to 30% by weight, based on the amount of the hydrophobic organic solvent. The ratio of the hydrophobic organic solvent to water is in the range of 1:10 to 10:1, preferably 1:5 to 3:1.

The polymer concentration is preferable approximately in the range of 5 to 80% by weight, specifically 10 to 60% by weight. Any polymer concentration less than 5% by weight is undesirable because the productivity is unduly low. Any polymer concentration exceeding 80% by weight is undesirable because the polymerization heat is generated in a large volume such as to elevate the temperature of the system excessively. The polymerization temperature is desired to be in the range of 10° to 120° C., preferably 30° to 90° C. The polymerization time is approximately in the range of 10 minutes to 10 hours, preferably 1 to 7 hours, though it is variable with the concentration of the monomer, the polymerization temperature, and the polymerization degree aimed at.

The aminoalkylation in the methods of (2) and (4) can be carried out by causing an alkylene imine to react with a vinyl type carboxylic acid polymer.

In this case, a divalent metal ion may be added, when necessary, to the vinyl type carboxylic acid polymer to induce partial formation of a chelate of the metal ion with carboxylic acid before the polymer is subjected to the aminoalkylation. There may be adopted otherwise a method of performing the aminoalkylation by alternately adding an alkylene imine and a neutral acid portionwise to the vinyl type carboxylic acid copolymer.

The aminoalkylation is preferable to proceed at a temperaturebelow 65° C., preferably in the range of 10° to 55° C. If this reaction temperature exceeds 65° C., the reaction solution undergoes gelation while the reaction is in process and the reaction product is opacified with insolubles. Conversely, if the reaction temperature is below 10° C., the reaction time is elongated infinitely and the reaction is consequently rendered meaningless.

The neutralization of the aminoalkyl group is effected to an extent in the range of 50 to 150 mol %, preferably 50 to 100 mol %, based on the amount of the added alkylene imine. It is effected collectively or divisionally during the course of the aminoalkylation. Though the neutral acid is not specifically defined, it is preferable to be hydrochloric acid, nitric acid, or sulfuric acid, for example.

In the production of the additive of this invention for the production of paper, the relative amounts of the vinyl type carboxylic acid monomer and the salt of an aminoalkyl ester monomer, the relative amounts of the vinyl carboxylic acid polymer and the alkylene imine, and the amount of the nonionic monomer must be fixed so that the cation equivalent amount, Cv, will be in the range of 1.0 to 15.0 meq/g, preferably 2.0 to 12.0 meq/g, the anionic equivalent amount, Av, in the range of 0.1 to 7.0 meq/g, preferably 0.2 to 6.0 meq/g, and the Cv/Av ratio in the range of 0.2 to 45.0, preferably 0.5 to 40.0. The terms "cation equivalent amount" and "anion equivalent amount" as used herein refer to the relevant effective components of solids of a sample minus the amounts of the neutral acid and the surfactant.

The additive of this invention for the production of paper is particularly excellent in the retention of the filler when the Cv/Av ratio is below 20. Any Cv/Av ratio below 0.2 is undesirable because the interreactivity of the additive with pulp is unduly weak, the drainage is poor, and the yield of the filler is ununiform. When the Cv/Av ratio exceeds, the additive particularly excels in water drainage and yield of the sizing agent. Any Cv/Av ratio exceeding 45 is undesirable because the cohesive force of the filler and the yield of the filler are both unduly low.

For the additive of this invention for the production of paper, the compositions of the component monomers and the conditions of polymerization are desired to be suitably set so that the viscosity of an aqueous 10% solution of the additive will be in the range of 50 to 100,000 cps, preferably 100 to 20,000 cps (Brookfield viscosity measured at pH 3.5 and 25° C.).

The kinds of pulp for which the additive for the production of paper according with this invention include ground pulp, thermomechanical pulp, sulfite pulp, semi-chemical pulp, Kraft pulp, various species of synthetic pulp, and the pulp produced by digesting used paper, for example. It is permissible to use the additive in combination with various adjuvants such as sizing agent, drainage aid, retention aid, slime controlling agent, defoaming agent, pitch-control agent, and pH adjusting agent, for example.

A pulp composition for the production of paper is obtained by adding to the pulp the additive for the production of paper according with the present invention in an amount in the range of 0.01 to 0.2% by weight, preferably 0.01 to 0.1% by weight, based on the amount of dry pulp.

By adding the additive for the production of paper produced as described above to pulp slurry under neutral conditions, the drainage of the pulp slurry can be improved and the additives such as filler and sizing agent can be uniformly retained in the paper in high yields.

Now, the present invention will be described more specifically below with reference to working examples. It should be noted, however, that the present invention is not restricted in any way by these examples.

Production of vinyl type carboxylic acid polymer

Referential Examples 1 to 4

Varying monomers indicated in Table 1 were placed in a reaction vessel in the weight ratio indicated correspondingly in a total amount calculated to account for a concentration of 20% by weight, based on the finished polymer. The monomers in the reaction vessel, with the entrapped air displaced with nitrogen, and ammonium persulfate and sodium hydrogen sulfite added thereto each in an amount of 0.2% by weight, based on the total amount of the monomers, were left polymerizing at 50° C. for 4 hours, to produce an aqueous solution of a vinyl type carboxylic acid polymer.

TABLE 1

| Referential Example | Monomers and weight ratio |
|---|---|
| 1 | AA = 100 |
| 2 | AA/AAm = 60/40 |
| 3 | AA/AAm = 35/65 |
| 4 | AA/AAm/AN = 60/35/5 |

AA: acrylic acid
AAm: acrylamide
AN: acrylonitrile

Production of additive for production of paper

Example A

In a reaction vessel, 167 g of the hydrochloride of aminoethyl methacrylate obtained by the reaction of methacrylic acid and ethylene imine and 33 g of acrylic acid were placed in a total proportion calculated to account for a concentration of 20% by weight based on the finished additive. The monomers in the reaction vessel, with the entrapped air displaced with nitrogen, and 0.2% by weight, based on the total amount of the monomers, of 2,2'-azobis(2-amidinopropane) dihydrochloride added thereto were polymerized for 4 hours, to obtain an additive A for the production of paper according with the present invention.

Example B

In a reaction vessel, 100 g of the aqueous solution of the vinyl type carboxylic acid polymer synthesized in Referential Example 1 and 73 g of deionized water were stirred at room temperature and the stirred aqueousn solution and 6.0 g of ethylene imine added thereto were left reacting at 50° C. for 2 hours. Then, the reaction solution and 10.1 g of 61 wt % nitric acid added thereto were stirred for 30 minutes. The reaction was continued, with 6.0 g of ethylene imine added thereto, for 1 hour. Then, the reaction solution and 10.1 g of 61 wt % nitric acid added thereto were stirred for 30 minutes, to obtain an additive B for the production of paper according with the present invention.

Examples C to H

The procedure of Example B was repeated, except that the conditions indicated in Table 2 were used instead.

TABLE 2

| Example | Polymer | Weight of polymer (g) | Weight of ethylene imine (g) | Final concentration (%) | Neutralizing acid: Kind of acid | Neutralizing acid: Weight of acid (g) |
|---|---|---|---|---|---|---|
| C | Referential Example 1 | 100 | 6.0 | 15 | 61% $HNO_3$ | 14.4 |
| D | Referential Example 1 | 100 | 12.0 | 15 | 35% HCl | 29.1 |
| E | Referential Example 1 | 100 | 17.7 | 20 | 61% $HNO_3$ | 29.7 |
| F | Referential Example 1 | 100 | 20.0 | 20 | 95% $H_2SO_4$ | 16.8 |
| G | Referential Example 2 | 100 | 20.1 | 20 | 61% $HNO_3$ | 33.7 |
| H | Referential | 100 | 20.1 | 20 | 61% $HNO_3$ | 33.7 |

TABLE 2-continued

| Example | Polymer | Weight of polymer (g) | Weight of ethylene imine (g) | Final concentration (%) | Neutralizing acid Kind of acid | Weight of acid (g) |
|---|---|---|---|---|---|---|
| | Example 4 | | | | | |

Example I

In a reaction vessel, 100 g of the aqueous solution of the vinyl carboxylic acid polymer synthesized in Referential Example 3 and 6.6 g of an aqueous 40% calcium chloride solution added thereto were homogenized and stirred at room temperature. The stirred solution and 4.2 g of ethylene amine added thereto were left reacting at 50° C. for 4 hours. The resultant reaction solution and 10.2 g of 35 wt % hydrochloric acid added thereto were stirred for 30 minutes, to obtain an additive I for the production of paper according with the present invention.

Controls A and B

TABLE 3

| Control | Weight of polymer of Referential Example (g) | Weight of ethylene imine (g) | Final concentration (%) | Neutralizing acid Kind of acid | Weight of acid (g) |
|---|---|---|---|---|---|
| A | 100 | 1.0 | 15 | 61% $HNO_3$ | 2.4 |
| B | 100 | 20.0 | 15 | 61% $HNO_3$ | 47.9 |

Example J

In a four-neck flask provided with a stirrer, a thermometer, a condenser, a dropping funnel, and a nitrogen gas inlet, 100 g of isoparaffin solvent (produced by Exxon Chemical K.K. and marketed under trademark designation of "Isobar M") was placed and 11.6 g of sorbitan monooleate was dissolved therein. The resultant solution was emulsified by gradual addition thereto of a mixed liquid prepared as an aqueous monomer solution by combining 80 g of acrylic acid, 20 g of acrylamide, 52.9 g of 28% aqua ammonia, and 33.9 g of deionized water. The resultant emulsion in the flask, with the interior of the system thoroughly displaced with nitrogen and heated to 60° C., and 0.7 g of azobis(-dimethyl valeronitrile) added thereto as a catalyst were heated at 60° C. and stirred for 4 hours, to produce a water-in-oil vinyl type carboxylic acid polymer emulsion.

This emulsion kept at 50° C. and 23.9 g of ethylene imine added dropwise thereto were stirred for 30 minutes. The resultant reaction solution and 57.4 g of an aqueous 61 wt % nitric acid solution added thereto were stirred for 30 minutes. The resultant mixture and 76.1 g of ethylene imine added dropwise thereto were stirred for 30 minutes. The mixture consequently formed and 110.7 g of an aqueous 61 wt % nitric acid solution were stirred for 30 minutes, to produce an additive J for the production of paper according with the present invention.

Example K

In a four-neck flask provided with a stirrer, a thermometer, a condenser, a dropping funnel, and a nitrogen gas inlet, 111.6 g of isoparaffin solvent (produced by Exxon Chemical K.K. and marketed under trademark designation of "Isobar M") was placed and 22.3 g of sorbitan monooleate was dissolved therein. The resultant solution was emulsified by gradual addition thereto of a mixed solution prepared as an aqueous monomer solution by combining 167 g of the hydrochloride of aminoethyl methacrylate obtained by the reaction of methacrylic acid and ethylene imine, 33 g of acrylic acid, and 135 g of deionized waterl. The emulsion in the flask, with the interior of the system thoroughly displaced with nitrogen and heated to 60° C., and 0.4 g of 2,2'-azobis(dimethyl valeronitrile) added thereto as a catalyst were heated at 60° C. and stirred for 8 hours, to produce an additive M for the production of paper according with the present invention.

Control C

In a reaction vessel, methacryloyloxyethyl trimethyl ammonium chloride (ADAM), AAm, and AA are combined in a 4DAM/Akm/AA weight ratio of 30/60/10 were placed in a total proportion calculated to account for a final concentration of 20% by weight were placed. The monomers in the reaction vessl, with the interior of the reaction vessel displaced with nitrogen and heated to 50° C., and 0.2% by weight, based on the total weight of the monomers, of 2,2'-azobis(2-amidinopropane) dihydrochloride added thereto were left polymerizing for 4 hours, to obtain an aqueous solution of amphoteric polymeric compound C for comparison.

The physical properties of the additives for paper production obtained in Examples A to K and Controls A to C.

TABLE 4

| | Cation equivalent value Cv (meq/g) | Anion equivalent value Av (meq/g) | Cv/Av | 10% viscosity (cps) |
|---|---|---|---|---|
| Example A | 5.5 | 2.8 | 2.0 | 550 |
| Example B | 7.9 | 1.9 | 4.2 | 450 |
| Example C | 4.8 | 5.3 | 0.9 | 440 |
| Example D | 8.0 | 0.5 | 16.0 | 330 |
| Example E | 9.9 | 3.5 | 2.8 | 700 |
| Example F | 10.4 | 1.5 | 6.9 | 390 |
| Example G | 10.5 | 0.3 | 35.0 | 1200 |
| Example H | 10.5 | 0.3 | 35.0 | 3100 |
| Example I | 3.6 | 2.0 | 1.8 | 185 |
| Example J | 11.6 | 0.5 | 23.2 | 5200 |
| Example K | 5.5 | 2.8 | 2.0 | 3400 |
| Control A | 1.0 | 12.1 | 0.08 | 1300 |
| Control B | 11.1 | 0.2 | 55.5 | 740 |
| Control C | 1.4 | 1.4 | 1.1 | 9500 |

The cation equivalent values and the anion equivalent values indicated in Table 4 and the text of the specification have been determined by the following methods.

(1) Cation equivalent value

In a beaker, 95 ml of distilled water was placed and 5 ml of an aqueous solution containing a sample in a concentration of 1000 ppm as available components was added. The resultant solution was adjusted to pH 3.0 by the addition of 1% HCl or 1% NAOH, then stirred for about 1 minute, and titrated with N/4 aqueous solution of polyvinyl potassium sulfate (PVSK) using 2 to 3 drops of a toluydine blue indicator solution. The titration speed was fixed at 2 ml per minute and the time completing at least 10 seconds' standing after the change of the color of the test solution from blue to red purple was taken as the end point of titration.

Cation equivalent amount (Cv) [meq/g] =
(amount of sample titration [ml] −
amount of blank titration [ml]) × potency of N/400 PVSK/2

The term "available components" refers to the components of the solids of the sample minus the neutral acid.

(2) Anion equivalent value

In a beaker, 50 ml of distilled water was placed and about 0.3 g of an accurately weighed sample was added thereto. The resultant solution was kept stirred and titrated with an aqueous N/10 NAOH solution. The degree of electroconductivity indicated on the scale was read out. The titration amount corresponding to the last of a plurality of points of inflection (points at which the whole acid was neutralized) was read out.

Anion equivalent amount (Av) [meq/g] =
0.1 × potency of N/10 NaOH ×
titration amount of N/10 NaOH [ml] −
amount of neutralizing acid in accurately weighed sample [ml])/
amount of available components in accurately weighed sample [g]

Examples 1 to 11

Paper sheets were produced by using the additives for paper production obtained in Examples A to K and tested for retension of calcium carbonate and dispersibility of calcium carbonate in paper. The results are shown in Table 5.

Controls 1 to 6

Paper sheets were produced by using respectively the additives for paper production obtained in Controls A to C, commercially avilable polyacrylamide Hofmann degradation product and poly ethylene imine and were tested for retention of calcium carbonate and dispersibility of calcium carbonate in paper. The results are shown in Table 5.

TABLE 5

| | Additive for paper production | Calcium carbonate Retention (%) | Calcium carbonate Dispersibility | Stockigt sizing degree (sec) | Freeness (ml) |
|---|---|---|---|---|---|
| Example | | | | | |
| 1 | Example A | 56 | ○ | 16 | 565 |
| 2 | Example B | 56 | ○ | 21 | 575 |
| 3 | Example C | 67 | ○ | 17 | 560 |
| 4 | Example D | 49 | ○ | 19 | 580 |
| 5 | Example E | 67 | ○ | 17 | 560 |
| 6 | Example F | 59 | ○ | 19 | 570 |
| 7 | Example G | 58 | ○ | 21 | 585 |
| 8 | Example H | 56 | ○ | 18 | 580 |

TABLE 5-continued

| | Additive for paper production | Calcium carbonate Retention (%) | Calcium carbonate Dispersibility | Stockigt sizing degree (sec) | Freeness (ml) |
|---|---|---|---|---|---|
| 9 | Example I | 62 | ○ | 16 | 565 |
| 10 | Example J | 60 | ○ | 18 | 595 |
| 11 | Example K | 58 | ○ | 19 | 590 |
| Control | | | | | |
| 1 | Control A | 19 | ○ | 8 | 525 |
| 2 | Control B | 34 | x | 20 | 580 |
| 3 | Control C | 52 | x | 16 | 570 |
| 4 | Polyacryl amide | 58 | x | 16 | 580 |
| 5 | Polyethylene imine | 32 | ○ | 15 | 575 |
| 6 | No additive | 19 | ○ | 13 | 520 |

The amount of additive was 400 ppm based on pulp slurry.
In Control 4, a commercially available Hoffman degradation product of polyacryl amide was used.
In Control 5, polyethylene imine produced by Nippon Shokubai Kagaku Kogyo Co., Ltd. and marketed under product code of P-1000 was used.

Conditions for paper production

The paper used for the test was produced under the following conditions.

Pulp: NBKP, filler heavy calcium carbonate (commercially available), pulp/filler ratio : 100/30, pH: 9.3, sizing agent AKD sizing agent: (commercially available) used in a concentration of 0.2% based on pulp slurry.

AKD: Alkyl Ketene dimer

Sequence of addition: Pulp—filler—sizing agent —additive of the invention—paper sheet.

Paper sheet: Tuppy square sheet machine.

Press: 3.5 kg/cm×2 minutes, drying: drum drier 110° C.×150 seconds.

Basis weight: 65 g/m

Method of evaluation

Retention of calcium carbonate: This property was determined by subjecting a sample paper produced under the conditions described above to a heat treatment at 600° C.×20 minutes and consequently finding the ash content.

Dispersibility of calcium carbonate: This property was determined by coloring calsium carbonate with a dye, producing paper sheet containing the colored calcium carbonate under the conditions described above, and visually examining the produced paper sheet as to the dispersion of the dye, and rating the result on the two-point scale, wherein ○ is satisfactory dispersion and × is rejectable dispersion.

Stöckigt sizing degree: This property was determined by measuring the sizing degree based on JIS P8122.

Freeness: This property was determined by adding a given additive to a 0.3% NBKP pulp slurry 1(pH 7.6) and measuring water permeation with a Canadian standard freeness tester (JIS P8121).

What is claimed is:

1. A pulp composition for paper production incorporating in said pulp composition 0.01 to 0.2% by weight, based on the amount of pulp, of an additive for paper production which comprises an amphoteric polymeric electrolyte having as an essential component thereof a structural unit represented by the following general formula I:

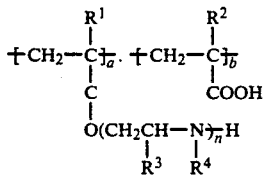

(I)

wherein n is an integer in the range of 1 to 5, $R^1$, $R^2$ and $R^3$ are independently a hydrogen atom or an alkyl group, $R^4$ is a hydrogen atom, an alkyl group, or a hydroxyalkyl group, and a and b are jointly relative numerals such that the a/b ratio is in the range of 0.2 to 45.0, having at least part of the amino group of said amphoteric polymeric electrolyte neutralized and possessing a cation equivalent amount (Cv) in the range of 1.0 to 15.0 meq/g, an anion equivalent amount (Av) in the range of 0.1 to 7.0 meq/g, and a Cv/Av ratio in the range of 0.2 to 45.0, said amphoteric polymer electrolyte being obtained by (A) allowing a vinyl carboxylic acid monomer to react with an alkylene imine to form an aminoalkyl ester monomer, copolymerizing a salt of said aminoalkyl ester monomer with a vinyl carboxylic acid monomer; or (B) polymerizing a vinyl carboxylic acid monomer, amino-alkylating the resulting vinyl carboxylic acid polymer with alkylene imine at a temperature of 65° C., and then, neutralizing the product with acid; or (C) allowing a vinyl carboxylic acid monomer with an alkylene imine, emulsifying as a water-in-oil type the resultant salt of aminoalkyl ester monomer and a vinyl carboxylic acid monomer emulsion in the presence of water, surfactant and hydrophobic organic solvent, and then, copolymerizing the product; or (D) emulsifying as a water-in-oil type emulsion a vinyl carboxylic acid in the presence of water, surfactant and hydrophobic organic solvent, polymerizing the resulting vinyl carboxylic acid emulsion, amino-alkylating the resulting vinyl carboxylic acid polymer emulsion with an alkylene imine at a temperature of not higher than 65° C., and then, neutralizing the product with acid.

2. A composition according to claim 1, wherein a viscosity of an aqueous 10% solution of said polymeric electrolyte molecular weight of said amphoteric polymeric (Brookfield viscosity at pH 3.5 and 25° C.) is in the range of 50 to 100,000 cps.

3. A composition according to claim 1, wherein said cation equivalent amount (Cv) is in the range of 3.0 to 12.0 meq/g, said anion equivalent amount (Av) is in the range of 0.2 to 6.0 meq/g, and said Cv/Av ratio is in the range of 0.5 to 40.0.

4. A pulp composition for paper production as set forth in claim 16 wherein the amphoteric polymeric electrolyte is contained in a water-in-oil type amphoteric copolymer.

5. A composition according to claim 1, wherein a viscosity of an aqueous 10% solution of said polymeric electrolyte molecular weight of said amphoteric polymeric (Brookfield viscosity at pH 3.5 and 25° C.) is in the range of 50 to 100,000 cps.

6. Paper, produced by molding in the form of sheet the pulp for paper production set forth in claim 1.

7. Paper, produced by molding in the form of a sheet the pulp for paper production set forth in claim 1, wherein a viscosity of an aqueous 10% solution of said polymeric electrolyte molecular weight of said amphoteric polymeric (Brookfield viscosity at pH 3.5 and 25° C.) is in the range of 50 to 100,000 cps.

8. Paper, produced by molding in the form of a sheet the pulp for paper production set forth in claim 1, wherein said cation equivalent amount (Cv) is in the range of 3.0 to 12.0 meq/g, said anion equivalent amount (Av) is in the range of 0.2 to 6.0 meq/g and said Cv/Av ratio is in the range of 0.5 to 40.0.

9. Paper, produced by molding in the form of a sheet the pulp for paper production set forth in claim 16, wherein the amphoteric polymeric electrolyte is contained in a water-in-oil type amphoteric copolymer.

10. Paper, produced by molding in the form of a sheet the pulp for paper production set forth in claim 1, wherein the amphoteric polymeric electrolyte is contained in a water-in-oil type amphoteric copolymer and wherein the cation equivalent amount (Cv) is in the range of 3.0 to 12.0 meq/g, said anion equivalent amount (Av) is in the range of 0.2 to 6.0 meq/g, and said Cv/Av ratio is in the range of 0.5 to 40.0.

* * * * *